US010471441B2

(12) United States Patent
Eberle et al.

(10) Patent No.: US 10,471,441 B2
(45) Date of Patent: Nov. 12, 2019

(54) ENERGY-ABSORBING HOUSING OF A CENTRIFUGE

(71) Applicant: Andreas Hettich GmbH & Co. KG, Tuttlingen (DE)

(72) Inventors: Klaus-Guenter Eberle, Tuttlingen (DE); Martin Kuster, Loeffingen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 135 days.

(21) Appl. No.: 15/549,380

(22) PCT Filed: Feb. 3, 2016

(86) PCT No.: PCT/EP2016/052293
§ 371 (c)(1),
(2) Date: Aug. 7, 2017

(87) PCT Pub. No.: WO2016/124649
PCT Pub. Date: Aug. 11, 2016

(65) Prior Publication Data

US 2018/0021790 A1 Jan. 25, 2018

(30) Foreign Application Priority Data

Feb. 6, 2015 (DE) ..... 10 2015 202 192

(51) Int. Cl.
*B04B 7/02* (2006.01)
*B04B 7/06* (2006.01)

(52) U.S. Cl.
CPC ..... *B04B 7/02* (2013.01); *B04B 7/06* (2013.01); *B04B 2007/065* (2013.01)

(58) Field of Classification Search
CPC .... B04B 5/02; B04B 7/02; B04B 7/06; B04B 2007/065; B04B 9/14
(Continued)

(56) References Cited

U.S. PATENT DOCUMENTS 3,111,863 A 11/1963 Filz
4,693,702 A * 9/1987 Carson ..... B04B 7/06 494/13
(Continued)

FOREIGN PATENT DOCUMENTS

DE 69404261 T2 11/1997
DE 102015202192 A1 8/2016
(Continued)

OTHER PUBLICATIONS

German Search Report for DE102015202192.0 dated Oct. 22, 2015.
(Continued)

*Primary Examiner* — Charles Cooley
(74) *Attorney, Agent, or Firm* — Womble Bond Dickinson (US) LLP; Joseph Bach, Esq.

(57) ABSTRACT

A housing of a centrifuge having an abutment for a ground on which the housing sits, as well as to a centrifuge. The housing is divided into two parts, i.e. a first housing and a second housing which is connected to the first housing via a pivot bearing, with at least one energy absorber being arranged between the first housing and the second housing, which energy absorber will counteract the forces, in particular the torques, generated in the event of a crash and will absorb the energy of the crash so as to prevent at least the part of the second housing which rests on the ground from moving relative to the ground, which pivot bearing allows the first housing to rotate relative to the second housing against the action of the one or plural energy absorber(s) which is/are separate from the pivot bearing.

20 Claims, 8 Drawing Sheets

(58) Field of Classification Search
USPC ..... 494/82
See application file for complete search history.

(56) References Cited

U.S. PATENT DOCUMENTS

| | | | | |
|---|---|---|---|---|
| 5,538,492 | A * | 7/1996 | Potter | B04B 7/06 494/12 |
| 6,063,017 | A * | 5/2000 | Romanauskas | B04B 7/02 494/12 |
| 7,331,918 | B2 * | 2/2008 | Hayasaka | B04B 7/02 494/12 |
| 7,367,932 | B2 * | 5/2008 | Niinai | B04B 5/0414 494/12 |
| 10,213,792 | B2 * | 2/2019 | Eigemeier | B04B 7/02 |
| 2005/0233884 | A1 * | 10/2005 | Hayasaka | B04B 7/02 494/60 |
| 2005/0272587 | A1 * | 12/2005 | Niinai | B04B 5/0414 494/12 |
| 2018/0021790 | A1 * | 1/2018 | Eberle | B04B 7/02 494/12 |

FOREIGN PATENT DOCUMENTS

| | | | |
|---|---|---|---|
| GB | 2082715 | A | 3/1982 |
| GB | 2101514 | A | 1/1983 |
| JP | H03-221162 | A | 9/1991 |
| WO | 2012/119000 | | 9/2012 |

OTHER PUBLICATIONS

International Search Report and Written Opinion for PCT/EP2016/052293 dated May 20, 2016.

DIN EN 61010-2-020 (VDE 0411-2-020): Safety requirements for electrical equipment for measurement, control, and laboratory use—Part 2-020: Particular requirements for laboratory centrifuges (IEC 61010-2-020:2006); German version EN 61010-2-020:2006. Mar. 2007.

* cited by examiner

ENERGY-ABSORBING HOUSING OF A CENTRIFUGE

RELATED APPLICATIONS

The present application is the national phase of International Application No. PCT/EP2016/052293, filed on Feb. 3, 2016, which claims priority to and the benefit of German Patent Application No. 10 2015 202 192.0, filed on Feb. 6, 2015, and the disclosures of which are hereby incorporated herein by reference in their entireties.

BACKGROUND

1. Field

The invention relates to a centrifuge housing as well as to a centrifuge having an abutment for a ground on which the housing sits.

2. Related Art

Centrifuges always have a housing. The housing is used to accommodate a safety vessel, a rotor and a drive for the centrifuge rotor, to mount these components safely within the housing and to protect the technical parts from unauthorized access. Moreover, the housing also has a protective function in the event of a crash, i.e. when a sample container accidentally disengages from the rotor. The housing then has to absorb part of the vast amount of energy produced in such a case. The kinetic energy of a laboratory centrifuge running at maximum speed is 40,000 Nm, for example. If, at such speed, a sample container becomes detached from the rotor and crashes into the safety vessel, part of this energy, above all rotational energy, will be absorbed by the immediate onset of the internal destruction process, i.e. by the plastic deformation of the safety vessel. The remaining part will aim to accelerate the centrifuge housing from its rest position, in particular in the previous direction of rotation of the rotor. Tests have shown that in the event of a crash the housing of the centrifuge will be rotated by between 180° and 360°. For safety reasons, it is therefore required and mandatory to leave sufficient clearance space all around the centrifuge housing.

This restricts the possibilities of directly mounting a centrifuge in laboratory systems, in particular self-loading and -unloading robotics systems. On the contrary, a lot of laboratory space has to be reserved for the centrifuges to allow for the resulting rotation of the centrifuge housing in the event of a crash and to prevent nearby equipment from being damaged by the rotating centrifuge. This is rather complex and costly and does not meet the demands made on today's compact and integrated laboratory units composed of devices, machines and furniture.

DIN EN 61010-2-020 requires a skilled person to ensure that a laboratory centrifuge operated as intended will not noticeably move away from its site of installation. Moreover, the laboratory centrifuge must not present a danger in the event of a crash. This standard therefore stipulates a safety zone of 300 mm for this purpose.

JP 0 322 11 62 A and GB 2 101 514 A disclose centrifuges which are integrated into the drawers of laboratory furniture.

DE 694 04 261 T2 relates to a safety bracket for mounting a centrifuge on a tabletop in a shock-absorbing manner. Bolts are used to connect the safety bracket to the tabletop and to the centrifuge housing. In the event of a crash, two safety brackets will absorb the resulting energy through elastic and plastic deformation.

It is the object of the invention to improve on a centrifuge housing in such a manner that the above shortcomings are avoided and that the housing can be readily integrated in laboratory systems in a space-saving manner, yet will afford sufficient protection in the event of a crash so as to prevent damage to adjacent units. Especially the energy produced in the case of a crash is to be absorbed systematically so that the previously required clearance space around the housing of a centrifuge is no longer necessary.

SUMMARY

The invention is based on the finding that a two-part design of the housing, a connection of the two housing parts by means of a joint and the provision of energy absorbers between the two housings will prevent rotation of the entire housing in the event of a crash. As a result of the two-part design and the joint connection, only the first housing will rotate in a predetermined manner relative to the second housing against the action of the energy absorbers. The second housing above all serves as a stationary anchor.

The present invention thus divides the housing into two parts, i.e. a first housing and a second housing which is connected to the first housing via a pivot bearing. At least one energy absorber is arranged between the first and second housings, which energy absorber will counteract the forces produced in the event of a crash and absorb crash energy so as to ensure that at least the part of the second housing which rests on a surface will not move relative to that surface, for which purpose the pivot bearing allows rotation of the first housing relative to the second housing against the effect of the one or plural energy absorber(s) that are separate from the pivot bearing. This is a simple way of preventing rotation of the entire housing in the case of a crash. According to the invention, it is rather only the first housing which will move relative to the second housing. The second housing will remain stationary in the case of a crash. The energy will largely be absorbed by the energy absorbers. The remaining energy will be transferred into the ground via the second housing. Systematic movement of the first housing relative to the second housing in the event of a crash will be ensured in a simple manner if the first housing is connected to the second housing by means of a pivot bearing. In the case of a crash, this will result in a relative rotation of the first housing with respect to the second housing against the action of the one or plural energy absorber(s) mounted separately from the pivot bearing. The energy can then be systematically directed into the one or plural energy absorber(s).

In one embodiment of the invention the energy absorber is formed from a plastically deformable material. An energy absorber of this kind can be made from deformation sheets, shear pins, shear sheets and the like. These absorb energy through plastic deformation and/or shearing.

It is also possible to produce the energy absorber from an elastically deformable material. In this case, the energy absorber acts like a spring over a load area, which spring may be formed by a damper on the one housing, which damper acts against a stop on the other housing. This is a simple way of absorbing the energy generated in a crash without any destruction and of preventing uncontrolled movement of the centrifuge.

In order to absorb the energy generated in the event of a crash as systematically as possible, it is advantageous if two energy absorbers, in particular of a different type each, are connected in series. It has shown that the energy caused by a crash is considerably higher at the outset than in the further course of time. Consequently, it is advantageous if a first energy absorber is formed from a plastically deformable material which absorbs the peak load, and a second energy absorber is formed from an elastically deformable material. In the event of damage, the first energy absorber is effective first and then the second energy absorber. The first energy absorber thus acts to absorb the higher energy suddenly arising before the second energy absorber becomes active and absorbs a smaller amount of energy with some delay. Preferably the first and second energy absorbers are different components that act between the first and second housings, in particular the first and second energy absorbers are arranged spaced apart between the first and second housings.

In one aspect of the invention, at least two energy absorbers are connected in parallel. This allows the energy load on the first and second housings to be distributed in an optimal and systematic manner.

Preferably the second housing part comprises the support, which latter is formed by a contact surface which rests flat on, and in full contact with, the ground. The support in particular comprises an anti-slip material and/or an anti-slip structure, at least on its surface resting on the ground. This ensures that the second housing will withstand the forces acting on the second housing, for example via the dampers, and resist them appropriately. This is a simple way of further diminishing the likelihood of the second housing being rotated.

To enable the second housing to fulfill its function as a stop or abutment for the first housing in a simple manner, at least one weight plate is provided in the second housing part which weight plate acts on the support. This increases the weight of the second housing and thus also the resisting force used to counteract the forces occurring in the event of a crash.

Moreover, a set of weight plates may also be provided so as to allow one or plural weight plate(s) to be mounted on the second housing, if necessary. Depending on the maximum load but also on the maximum speed of the centrifuge, the housing and the necessary resistive force can thus be adapted in a simple manner.

According to one embodiment of the invention, receiving means for a safety vessel, a rotor and a drive of the centrifuge are provided in the first housing, for example in the form of recesses, bores for fastening means and the like. This makes it easy to integrate the safety vessel, the rotor and the drive of the centrifuge into the first housing. The movable parts of the centrifuge are thus disposed in the first housing. In the event of a crash which is usually caused by a sample container or sample carrier disengaging from the rotor, the safety vessel will thus be the first to be deformed by sample carriers and sample containers crashing into it.

This will absorb a high initial amount of energy. The remaining energy will act on the first housing and thus on the one or plural energy absorber(s) between said first and second housings.

As an alternative, the first housing may also be adapted to receive a standard centrifuge, a laboratory centrifuge or any other standalone centrifuge having its own housing. In this case, the centrifuge will merely have to be introduced into the first housing and secured to the interior of the first housing. The advantages and design options of the present invention can therefore easily be achieved in already existing centrifuges.

Preferably limiting means are provided which prevent movement along an axis of rotation of the pivot bearing. Limiting means are in particular integrated into the pivot bearing. This further channels the energy directly onto the energy absorbers. The total energy absorption is thereby optimized further.

In a preferred embodiment of the invention the external dimensions of the second housing and the external dimensions of the first housing are matched to one another in such a way that in the event of a crash, as the first housing moves to a defined end position relative to the second housing, the first housing, as viewed from the top, will always remain within the second housing, at least within an envelope of the second housing.

Preferably stops are provided in the housing which determine the defined end position of the first housing relative to the second housing. This allows the end position to be defined and specified using structurally simple means.

In an embodiment of the invention the second housing is of a two-part design, i.e. an anchoring part and a top part. The top part of the second housing is connected to the first housing and can be displaced translationally relative to the second housing. As a result, inspection of the first housing, which is connected to the top part of the second housing and comprises the relevant moving parts of the centrifuge, can be performed without any difficulty. If the housing is integrated into a laboratory unit, for example, translationally displacing the first housing together with the top part of the second housing relative to the anchoring part of the second housing will make the housing accessible for inspection and maintenance.

Here it is advantageous if the top part can be telescoped relative to the anchoring part using telescopic rails. This facilitates the translational displacement.

In one aspect of the invention the invention relates to a centrifuge which has a housing of the type described above.

A design is considered advantageous which is intended as a built-in device for integration in a laboratory unit of laboratory furniture and/or laboratory equipment since the design according to the invention requires less space in the laboratory, yet the two-part design of the housing prevents damage to nearby equipment and furniture of the laboratory unit in the event of a crash.

BRIEF DESCRIPTION OF THE DRAWINGS

Additional advantages, features and possible applications of the present invention may be gathered from the description which follows in conjunction with the embodiments illustrated in the drawings.

Throughout the description, the claims and the drawings, those terms and associated reference signs are used as are listed in the List of Reference Signs below. In the drawings.

DETAILED DESCRIPTION

Figure 1:
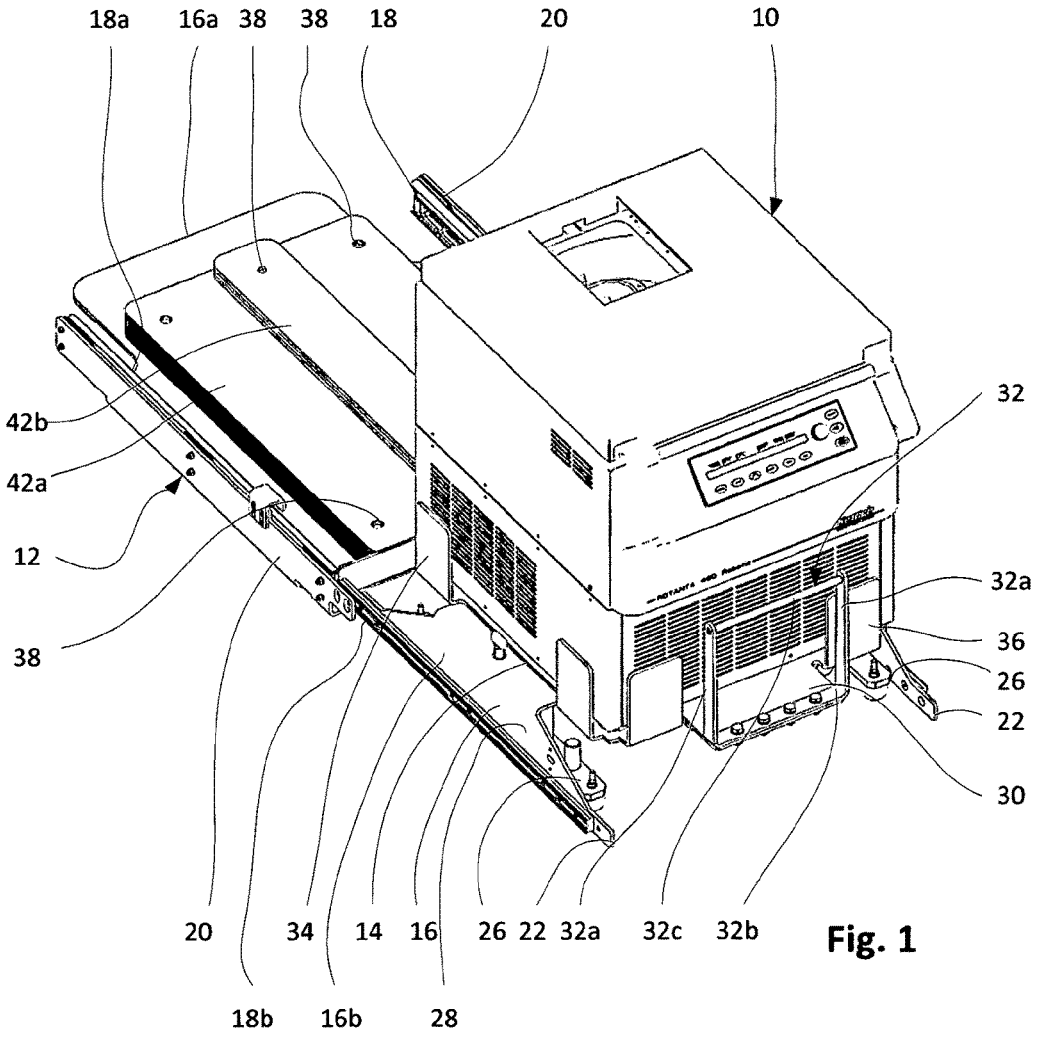
FIG. 1 is a perspective view of a centrifuge in the telescoped condition and having a housing according to the invention.
Figure 2:
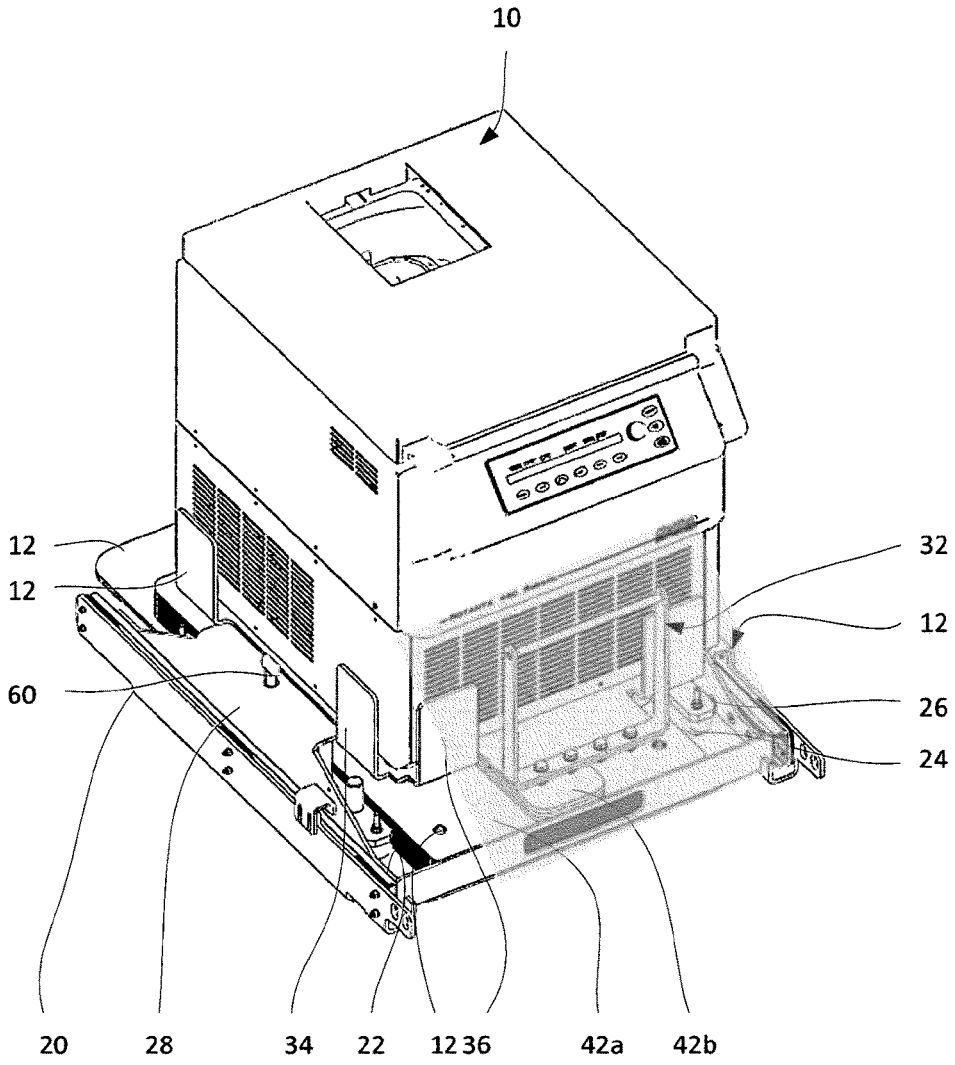
FIG. 2 is a perspective view of a centrifuge as illustrated in FIG. 1 in the retracted state.
Figure 3:
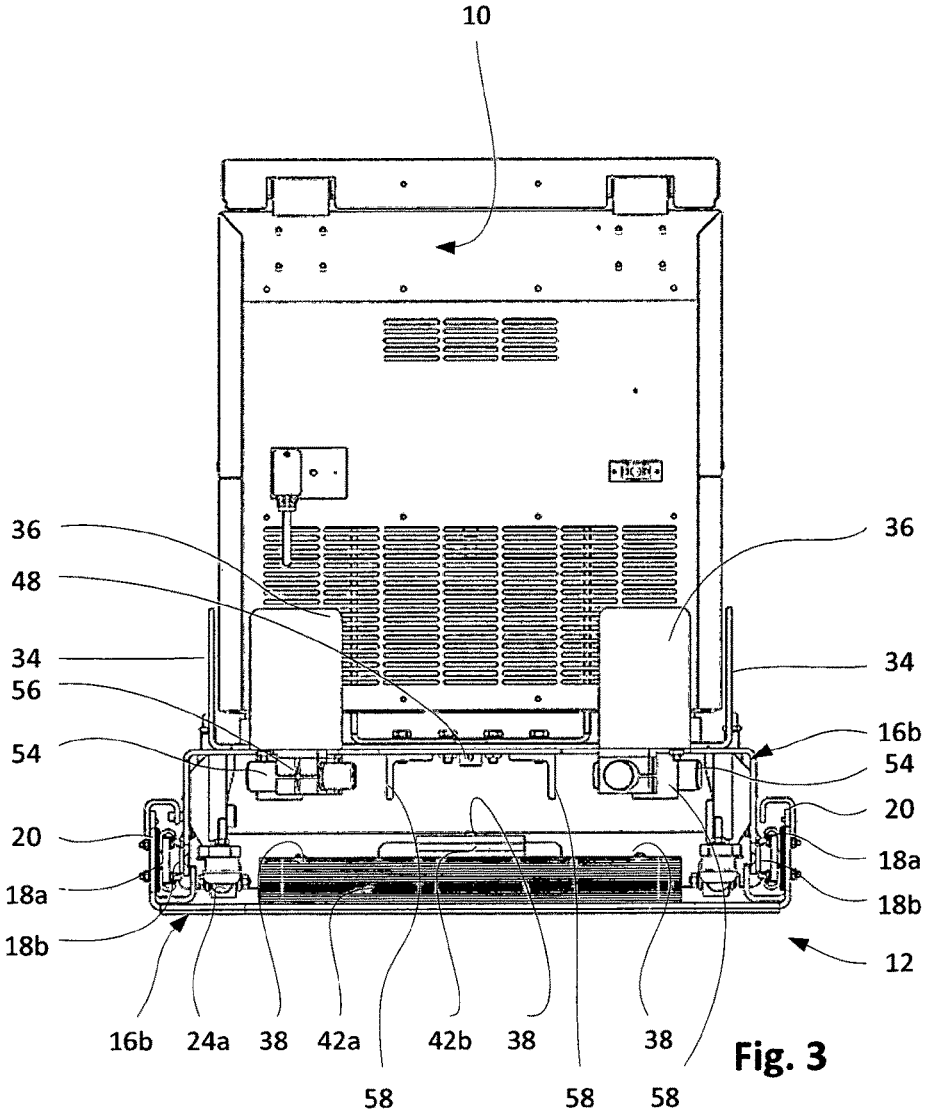
FIG. 3 is a rear view of the centrifuge of FIG. 2.
Figure 4:
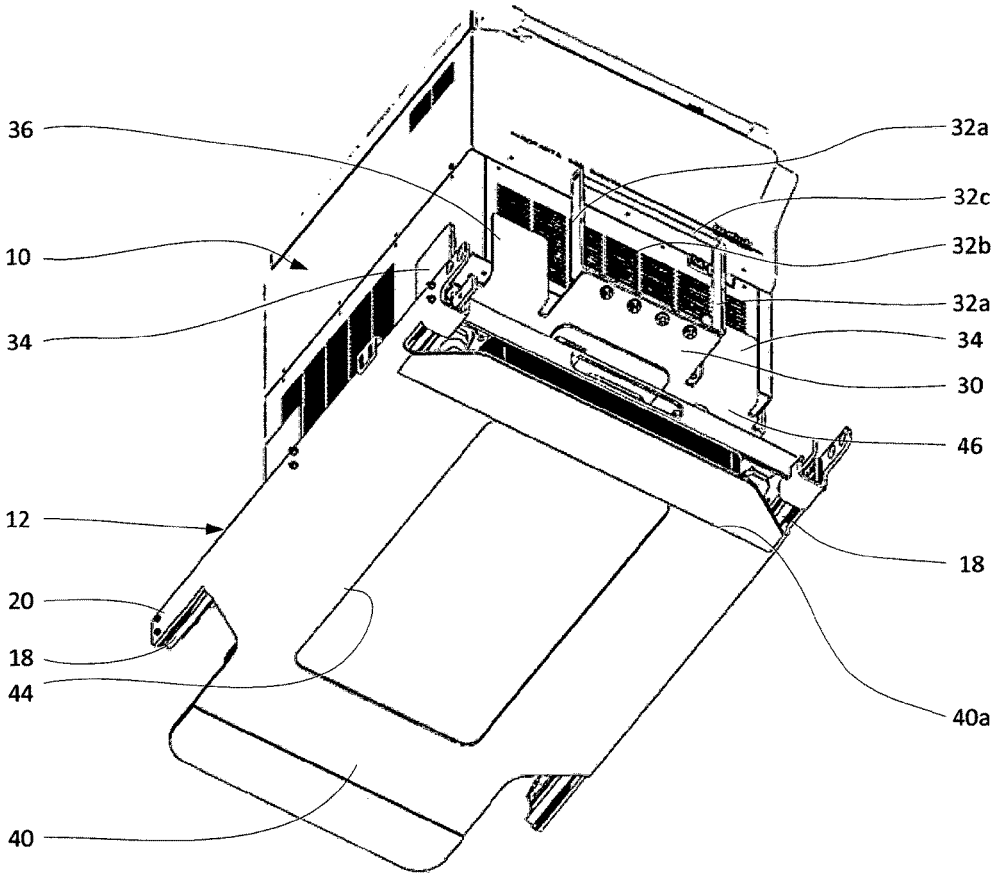
FIG. 4 is a perspective detailed view of the underside of the centrifuge of FIG. 2 from an angle.

The views of FIG. 1 through 5 illustrate a centrifuge 10 which is arranged in a housing 12 according to the invention. The centrifuge 10 is a standard laboratory centrifuge with its own centrifuge housing. The centrifuge housing is mounted in the housing 12, as will be described in more detail below. Alternatively, however, the housing 12 can also be an integral part of the centrifuge housing but will otherwise fulfill the same functions as the housing 12, as will be described in the following.

The housing 12 is of a two-part design and has a first top housing part 14 and a second bottom housing part 16.

The second, i.e. the bottom housing part 16 is also of a two-part design. The bottom housing part 16 comprises an anchoring part 16*a* and a top part 16*b*. Via telescopic rails 18, the top part 16*b* can be translationally displaced relative to the anchoring part 16*a* along the telescopic rails 18. For this purpose, the anchoring part 16*a* is provided with a side wall 20 each. On the inner side of the side wall 20 a first telescopic rail 18*a* each is screw-connected to the side wall 20. A second telescopic rail 18*b* is slidably arranged in the first telescopic rail 18*a*, which second rail 18*b* is firmly connected to the top part 16*b* of the bottom housing part 16. For this purpose the top part 16*b* has longitudinal skids 22 which are each screw-connected to the second telescopic rail 18*b*.

Laterally mounted on the downward facing surface of the top part 16*b* are downward movable rollers 24, In total, four ball casters 24*a* and two platen rollers 24*b* are provided. At the front and at the back a ball caster 24*a* each is mounted laterally, i.e. a total of four ball casters 24*a*. In addition, platen rollers 24*b* are provided at the center between the ball casters 24*a*. The casters and rollers 24 are each mounted on a roller carrier 26 which each extends laterally parallel to the longitudinal skid 22, which carrier 26 is arranged offset towards the bottom relative to a horizontally extending carrier platform 28 of the top part 16*b*. The carrier 26 is used to move the casters or rollers downward by means of a manual drive 60. The arrangement of casters and rollers 24 can be gathered in particular from FIGS. 7*a* and 7*b*.

The anchoring part 16*a* and the top part 16*b* are arranged symmetrically relative to their longitudinal central axis. The telescopic rails 18 are aligned parallel to the longitudinal central axis.

On the front side, in an extension of the carrier platform 28 of the top part 16*b*, a forward-extending projection 30 is provided. Bolted to this projection 30 is a handle 32 with lateral support members 32*a*, a bottom cross-member 32*b* and a handrail 32*c* which connects the two lateral support members 32*a*.

The top housing part 14 is mounted parallel to the carrier platform 28. The top housing part 14 comprises a receiving plate 46 which has limiting tongues 34 and 36 at its corners, which limiting tongues extend towards each other. The limiting tongues 34 are each oriented along the longitudinal axis of the housing 12 while the limiting tongues 36 are each oriented perpendicular to the longitudinal axis of the housing 12.

A pivot joint 48 connects the receiving plate 46 of the top housing part 14 to the carrier platform 28 of the top part 16*b* of the bottom housing part 16. The pivot joint 48 moreover supports the carrier platform 28 in an axial direction along the axis of rotation of the pivot joint 48. For this purpose, the pivot joint 48 has an upper flange 48*a* which abuts on the top side of the receiving plate 46. A lower flange 48*b* abuts on the bottom side of the carrier platform 28. Furthermore, two shear pins 50 are used to connect the top housing part 14 to the bottom housing part 16, i.e. to the top part 16*b*, in particular the receiving plate 46 of the top housing part 14 to the carrier platform 28 of the top part 16*b* of the bottom housing part 16. The shear pins 50 are adapted to keep the top housing part 14 oriented in a predetermined manner relative to the bottom housing part 16.

The anchoring part 16*a* is provided with six bearing pins 38. The bearing pins 38 extend vertically upwards from the support wall 40 and engage a plurality of weight plates 42 which are vertically stacked on the support wall. The lower weight plates 42*a* have a larger surface area than the upper weight plates 42*b* stacked on them. The upper weight plates are merely held by two bearing pins 38 which are mounted in the area of the longitudinal axis of the housing 12.

A sidewall 20 each extends vertically upwards from the support wall 40. The underside of the support wall 40 has a rubber coating 40*a* so as to increase the frictional connection to the ground on which the housing 12 with the centrifuge 40 sits. The central area of the support wall 40 has a rectangular recess 44 for increasing the frictional connection of the support wall 40 to the ground by reducing the bearing surface.

Figure 5:
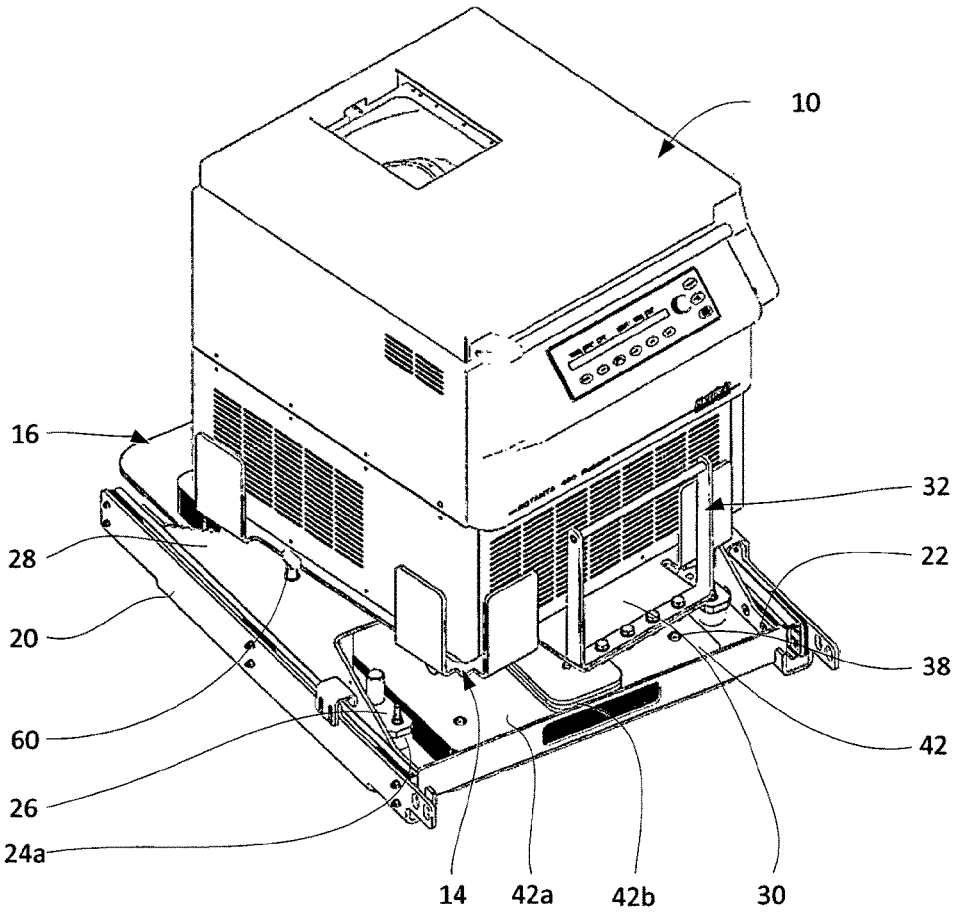
FIG. 5 is a perspective view of the front of the centrifuge of FIG. 2, from an angle, but in a rotated state.
Figure 6A:
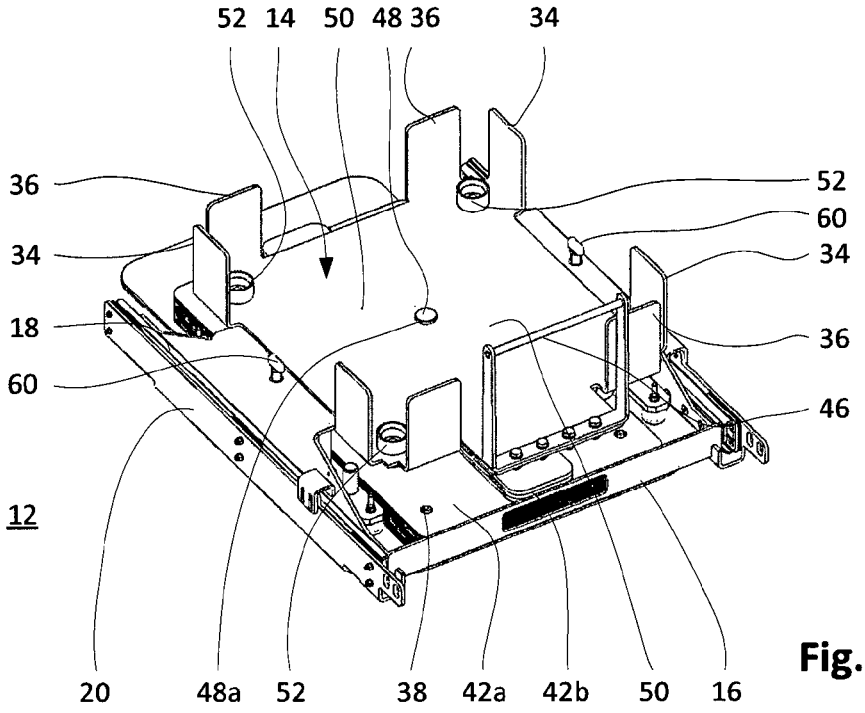
FIG. 6*a* is a perspective detailed view of the housing for the centrifuge of FIG. 1, as seen at an angle from above, in a non-rotated state.
Figure 6B:
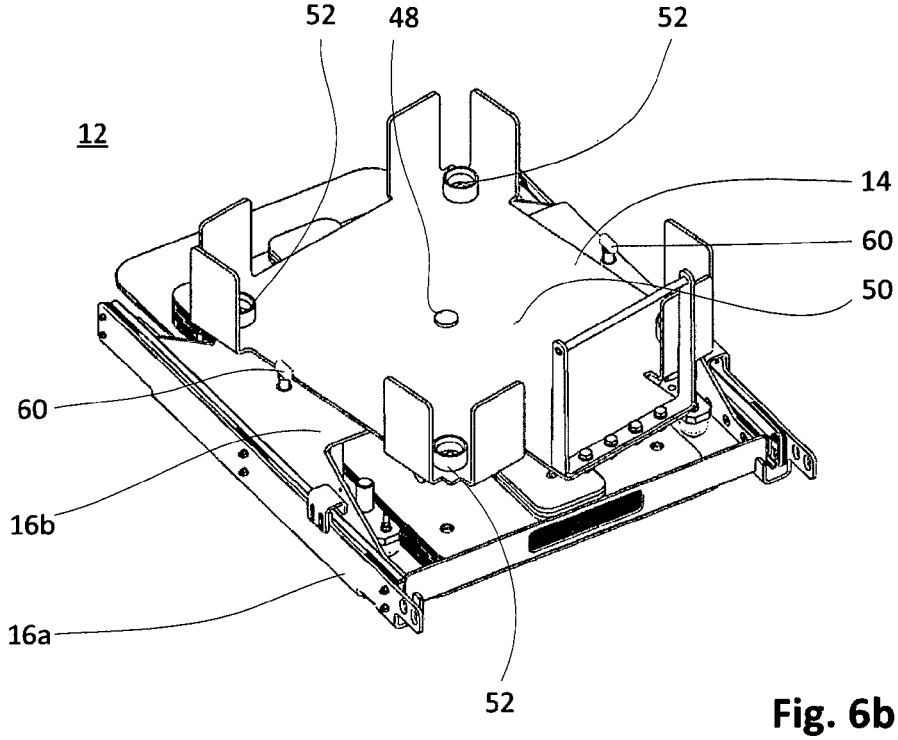
FIG. 6*b* is a perspective detailed view of the housing for the centrifuge of FIG. 1, as seen at an angle from above, in which the centrifuge has been rotated into its end position.
Figure 7A:
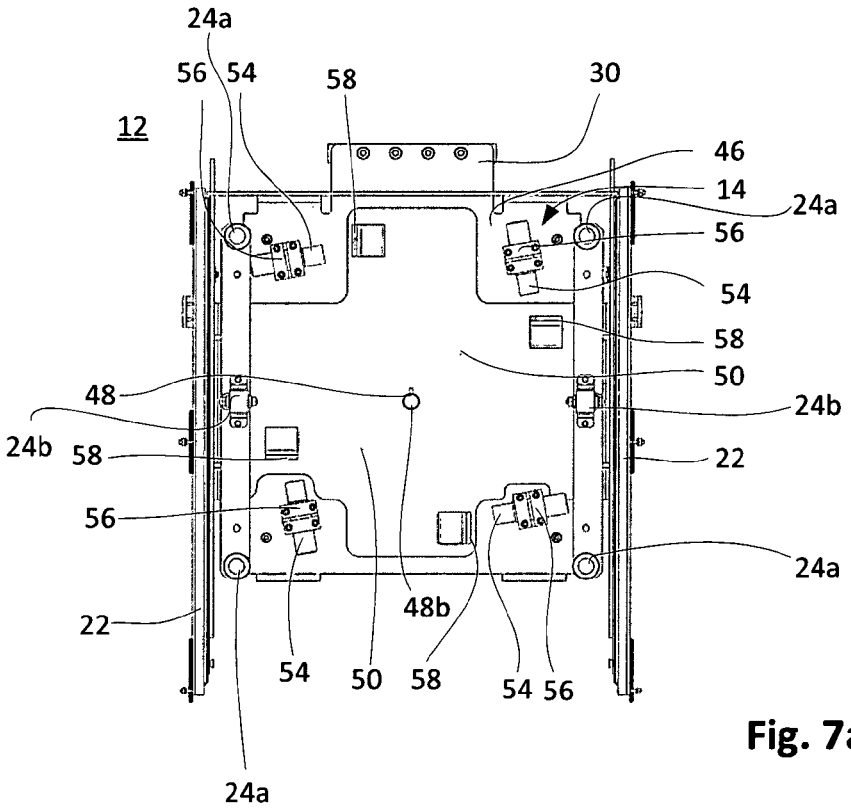
FIG. 7*a* is a bottom view of the housing without the anchoring part, which view shows the top part of FIG. 6*a;*
Figure 7B:
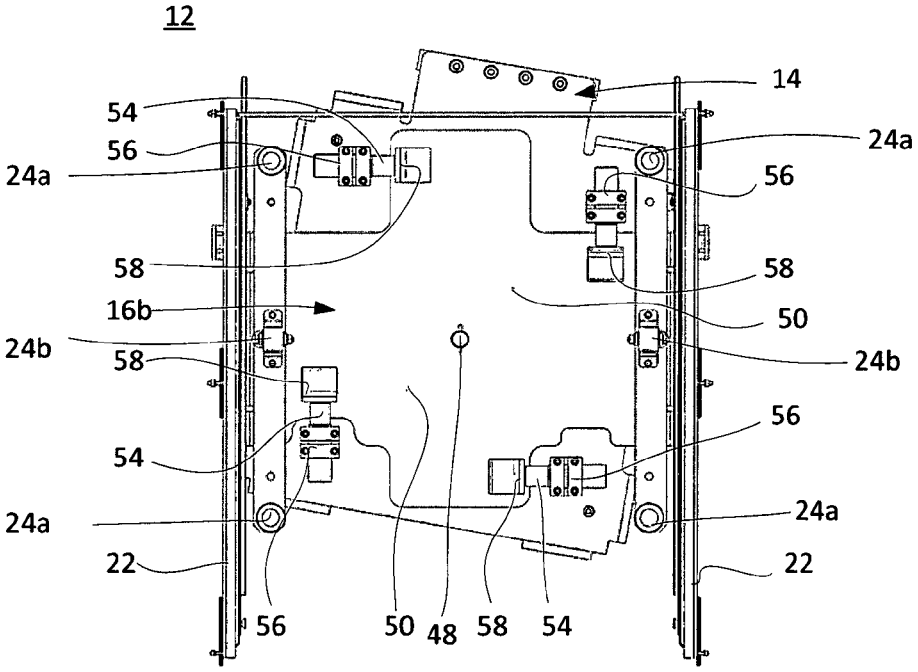
FIG. 7*b* is a bottom view of the housing without the anchoring part, which view shows the top part of FIG. 6*b*.
Figure 8:
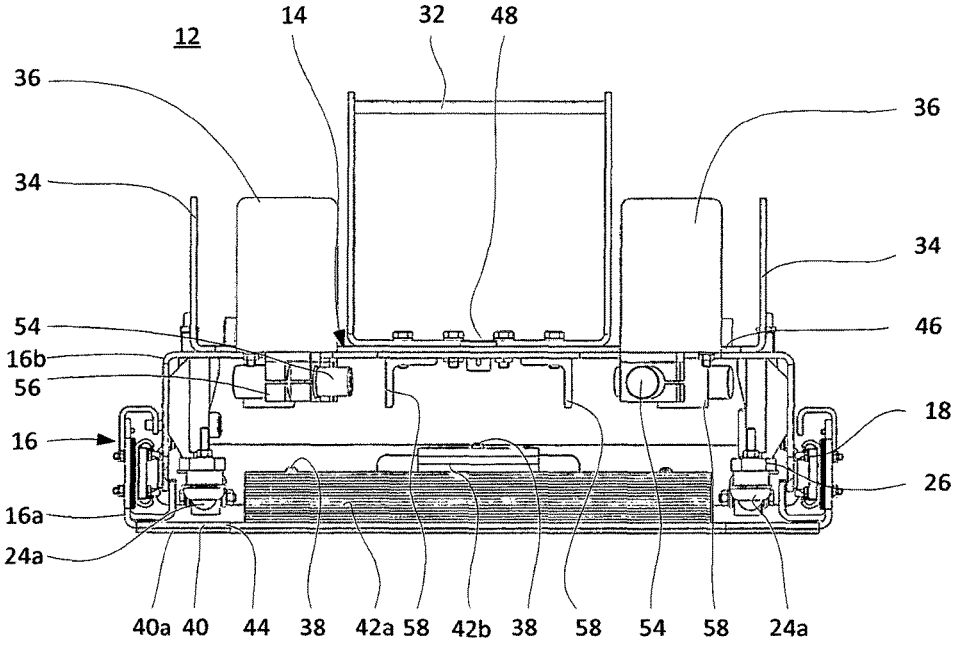
FIG. 8 is a view of the rear of the housing of FIG. 6*a*.

FIGS. 6*a*, 6*b*, 7*a*, 7*b* and 8 are views of the housing 12 without the centrifuge 10. FIGS. 6*a* and 7*a* are views of the top housing part 14 in its starting position relative to the bottom housing part 16. The starting position shows the situation in normal operation. FIGS. 6*b* and 7*b* illustrate the top housing part 14 after it has been rotated from its starting position into a defined end position relative to the bottom housing part 16. This end position shows the situation of the housing 12 after a crash with maximally loaded damping elements 54. This situation is also shown in FIG. 5 which is a view of the centrifuge 10 placed in the housing 12. FIG. 8 is a view of the housing 12 in its starting position.

FIGS. 6*a* to 7*b* illustrate the shear pins 50 and the centrally arranged pivot joint 48. The shear pins 50 are arranged point-symmetrically relative to the pivot joint 48 and engage both in the receiving plate 46 and in the carrier platform 28 mounted below it.

At each corner of the receiving plate 46 of the top housing part 14, in the area of the limiting tongues 34, 36, a receiving cup 52 is provided which is open towards the top and adapted to receive a foot each of the centrifuge 10. These receiving cups 52 are used to securely mount the centrifuge 10 in the housing 12 via its feet.

Below the receiving plate 46 of the top housing part 14 damping elements 54 are provided which are firmly connected to the underside of the receiving plate 46 via associated holders 56, see in particular FIGS. 7*a* and 7*b* in this respect. The damping elements 54 are associated with stops 58, which stops 58 are firmly connected to the top part 16*b* of the bottom housing part 16, i.e. the carrier platform 28.

On the side of the receiving plate 46 disposed above the carrier platform 28, the carrier platform 28 is provided with the manual drive 60. The manual drive 60 for the caster and roller carrier 26 is arranged on the upper side of the carrier platform 28.

As already set out above, in normal operation, the top housing part 14 is oriented relative to the bottom housing part 16 in the manner illustrated in FIGS. 2, 3, 4, 6*a*, 7*a* and 8, i.e. the longitudinal central axis of the top housing part 14 and the longitudinal central axis of the bottom housing part 16 are aligned parallel to one another. However, in the event of a crash during operation of the centrifuge 10, i.e. a sample carrier or a sample container disengaging from the rotor, such sample carrier or container will first hit the safety vessel surrounding the rotor in the centrifuge 10. However, the energy involved in the crash is so high that the deformation of the safety vessel caused by the part slamming into the safety vessel will not suffice to absorb such energy completely. Consequently, high forces will continue to act in the direction of rotation of the rotor of the centrifuge 10. These forces are transferred via the centrifuge 10, i.e. the feet of the centrifuge 10, to the receiving cups 52 and thus to the top housing part 14. The pivot joint 48 and the axial limitation by the upper flange 48*a* and the lower flange 48*b* towards the top and the bottom thus act to apply a high torque to the top housing part 14. This torque will initially result in a plastic deformation of the shear pins 50 through the rotation of the top housing part 14 relative to the bottom housing part 16 in the effective direction of the applied torque, until the shear pins 50 break. This absorbs another portion of the energy.

The top housing part 14 will then no longer be blocked by the shear pins 50, as the latter were broken, and thus continues rotation relative to the bottom part of the housing 16 in a direction until the damping elements 54 abut on the stops 58, since a torque still acts on it owing to residual energy which has not been absorbed. Rotation of the top housing part 14 now continues against the spring force of the damping elements 54. The angle of rotation at which the top housing part 14 can be rotated against the spring force of the damping elements 54 is limited by end stops which are constituted by the maximum displacement path/spring travel of the damping elements 54. Alternatively, it is possible to provide separate end stops. The top housing part 14 will abut on the end stops at a predefined angle of rotation. The residual energy will then be transferred to the bottom housing part 16, in particular the anchoring part 16*a*, via stops 58. As the anchoring part 16*a* has a rubber coating 40*a* on the underside of the support wall 40 and the weight plates 42 act on the support wall 40, the frictional connection of the ground to the support wall 40 with the rubber coating 40*a* will ensure an effective abutment against the applied torque, due to the residual energy acting on it. The energy will be transferred into the ground by the support wall 40 and the rubber coating 40*a*. The rubber coating 40*a* may additionally be provided with anti-slip structures.

The shear pins 50 thus constitute two energy absorbers which are connected in parallel and which absorb energy in the event of a crash through their plastic deformation. Connected in series relative to the shear pins 50 are additional energy absorbers, i.e. the damping elements 54 which cooperate with the stops 58. The stops 58 and the maximum displacement path of the damping elements 54 define the end position of the top housing part 14 relative to the bottom housing part 16. Here the top housing part 14 within the bottom housing part 16 will remain at least within the envelope of the bottom housing part 16.

This allows the centrifuge 10 with the housing 12 to be integrated into a laboratory unit consisting of further equipment and laboratory furniture without the risk of damage to nearby equipment or laboratory furniture as a result of housing parts being rotated in the event of a crash. This optimizes the space requirements for the centrifuge 10 without increasing the risk of damage to nearby laboratory units.

The fact that the top part 16*b* can be telescoped relative to the anchoring part 16*a* facilitates maintenance of the centrifuge 10. As the casters and rollers 24 can be moved vertically and the top part 16*b* can be removed from the anchoring part 16*a*, the top part can be displaced together with the centrifuge. For this purpose, the casters and rollers 24 are moved toward the bottom until the top part 16*b* with the centrifuge 10 sits on the casters and rollers 24. The longitudinal skids 22 of the top part 16*b* are then each detached from the second telescopic rail 18*b*. The operator can then use the handle 32 not only to translationally move the centrifuge 10 on the telescopic rails 18 along the longitudinal central axis but also to move the centrifuge 10 on the casters and rollers 24 after the centrifuge 10 has been detached from the telescopic rails 18 and the casters and rollers 24 have been moved downwards.

In addition, the housing 12 can be provided with an outer wall which surrounds the housing 12 and the centrifuge 10. The outer wall is connected to the anchoring part 16*a*. However, the outer wall is not illustrated in the figures for reasons of clarity.

As has already been addressed at the beginning hereof, the housing 12 can also be an integral part of the centrifuge 10. In such case the centrifuge 10 will not have a separate housing but the centrifuge housing will be part of the housing 12. This housing 12 will then directly accommodate the safety vessel, the rotor, the rotor drive, i.e. in the top housing part 14. Its mode of action in the event of a crash will be the same.

The invention is characterized by the simple and space-saving option of absorbing energy through plastic deformation on the one hand, and through elastic deformation on the other, and a defined movement in the event of a crash by the pivot joint 48 up to a defined end position. The option of introducing individual weight plates 42 into the anchoring part 16*a* allows conditions to be adapted to every situation of operation of the centrifuge 10. In the event of a crash, the anchoring part 16*a* will always remain firmly and safely on the ground without moving from its starting position.

LIST OF REFERENCE SIGNS

14 top housing part
16 bottom housing part
16*a* anchoring part
16*b* top part
18 telescopic rails
18*a* first telescopic rail
18*b* second telescopic rail
20 side wall
22 longitudinal skids of top part 16*b*
24 casters and rollers
24*a* ball casters
24*b* platen rollers
26 caster and roller carrier
28 support plate
30 projection
32 handle
32*a* support member
32*b* lower cross member
32*c* handrail
34 limiting tongue, extending along longitudinal axis
36 limiting tongue, extending transversely relative to the longitudinal axis
38 bearing pins
40 support wall
40*a* rubber coating

42 weight plates
42*a* lower weight plate
42*b* upper weight plate
44 recess
46 receiving plate of the top housing part 14
48 pivot joint
48*a* upper flange of pivot joint 48
48*b* lower flange of pivot joint 48
50 shear pins
52 receiving cups
54 damping elements
56 holder for damping elements 54
58 stops
60 manual driver

The invention claimed is:

1. Housing of a centrifuge having an abutment for a ground on which the housing sits, characterized by a two-part design of the housing comprising a first housing and a second housing which is connected to the first housing via a pivot bearing, with at least one energy absorber being arranged between the first housing and the second housing which energy absorber will counteract the forces generated in the event of a centrifuge crash and will absorb the energy of the crash so as to prevent at least the portion of the second housing which rests on the ground from moving relative to the ground, which pivot bearing allows the first housing to rotate relative to the second housing against the action of the one or plural energy absorber(s) which is/are separate from the pivot bearing.

2. Housing according to claim 1, characterized in that the energy absorber is formed from a plastically deformable material.

3. Housing according to claim 1, characterized in that the energy absorber is formed from an elastically deformable material; comprising dampers provided on one of the first and second housing, which dampers act against stops provided on the other of the first and second housing.

4. Housing according to claim 1, characterized in that two energy absorbers are connected in series.

5. Housing according to claim 4, characterized in that a first energy absorber is formed from a plastically deformable material, a second energy absorber is formed from an elastically deformable material, and that in the event of a crash, the first energy absorber will be the first to become effective and then the second energy absorber.

6. Housing according to claim 5, characterized in that the first and second energy absorbers are different components acting between the first and second housings, wherein the first and second energy absorbers are arranged spaced apart from each other between the first and second housings.

7. Housing according to claim 1, characterized in having at least two energy absorbers are connected in parallel.

8. Housing according to claim 1, characterized in that the second housing includes the abutment, which abutment is formed by a support surface which rests flat on, and in full contact with, the ground.

9. Housing according to claim 8, characterized in that the abutment is provided with an anti-slip material and/or an anti-slip structure, at least on its surface which makes contact with the ground.

10. Housing according to claim 8, characterized in that at least one weight plate is provided in the second housing part which acts on the abutment.

11. Housing according to claim 10, characterized in that a set of weight plates is provided so as to allow one or plural weight plates to be mounted on the second housing.

12. Housing according to claim 1, characterized by a receiving arrangement for a safety vessel, a rotor and a drive of the centrifuge are provided in the first housing.

13. Housing according to claim 1, characterized in that the first housing is adapted to receive and securely accommodate a standard centrifuge, a laboratory centrifuge or any other standalone centrifuge having its own centrifuge housing.

14. Housing according to claim 1, characterized in that a limiting arrangement is provided which prevents movement along a pivot axis of the pivot bearing.

15. Housing according to claim 1, characterized in that the external dimensions of the second housing and the external dimensions of the first housing are matched to each other such that, in the event of a crash, the first housing will always remain within the second housing, at least within an envelope of the second housing, as the first housing moves relative to the second housing up to a defined end position.

16. Housing according to claim 15, characterized in that stops are provided in the housing, which stops determine the defined end position of the first housing relative to the second housing.

17. Housing according to claim 1, characterized in that the second housing is of a two-part design consisting of an anchoring part and a top part, in which the top part of the second housing is connected to the first housing and can be translationally moved relative to the anchoring part of the second housing.

18. Housing according to claim 17, characterized in that the top part can be telescoped relative to the anchoring part via telescopic rails.

19. A centrifuge mounted in a two-part housing, the two-part housing comprising:

a first housing and a second housing which is connected to the first housing via a pivot bearing, with at least one energy absorber being arranged between the first housing and the second housing which energy absorber will counteract the forces generated in the event of a centrifuge crash and will absorb the energy of the crash so as to prevent at least the portion of the second housing which rests on the ground from moving relative to the ground, which pivot bearing allows the first housing to rotate relative to the second housing against the action of the one or plural energy absorber(s) which is/are separate from the pivot bearing.

20. Centrifuge according to claim 19, characterized by an embodiment as a built-in device for integration into a laboratory unit consisting of laboratory furniture and/or laboratory equipment.

* * * * *